US006165016A

United States Patent [19]

Lai

[11] Patent Number: 6,165,016

[45] Date of Patent: Dec. 26, 2000

[54] ELECTRICAL CONNECTOR

[75] Inventor: Chin-Te Lai, Tu-Chen, Taiwan

[73] Assignee: Hon Hai Precision Ind. Co., Ltd., Taipei Hsien, Taiwan

[21] Appl. No.: 09/388,108

[22] Filed: Sep. 1, 1999

[30] Foreign Application Priority Data

Jun. 15, 1999 [TW] Taiwan ..... 88209846

[51] Int. Cl.[7] ..... H01R 13/648

[52] U.S. Cl. ..... 439/610

[58] Field of Search ..... 439/607–610, 439/101, 108

[56] References Cited

U.S. PATENT DOCUMENTS 5,518,421 5/1996 Davis ..... 439/610
5,683,269 11/1997 Davis et al. ..... 439/610
5,725,395 3/1998 Lee ..... 439/610
5,938,476 8/1999 Wu et al. ..... 439/610
5,941,733 8/1999 Lai ..... 439/610

*Primary Examiner*—Gary F. Paumen
*Attorney, Agent, or Firm*—Wei Te Chung

[57] ABSTRACT

A USB connector comprises an insulative housing, a plurality of terminals, a top cover and a front shell. The front shell includes a bottom wall, a pair of side walls upwardly extending from opposite edges of the bottom wall, and a pair of half top walls inwardly extending from edges of the side walls and defining a seam therebetween. The front shell has an exposed insertion end for facilitating insertion of the housing to be inserted thereinto. A strain relief portion extends from a bottom wall of the front shell proximate the insertion end. A carrier is connected to the strain relief portion. In an automatic assembly process, the housing is inserted into the front shell through the insertion end.

1 Claim, 4 Drawing Sheets

ELECTRICAL CONNECTOR

BACKGROUND OF THE INVENTION

The present invention generally relates to an electrical connector, and particularly to an electrical connector having a housing which can be automatically assembled to a shielding member.

A USB (Universal Series Bus) connector is commonly used for the transmission of high frequency signals and is provided with an I/O port for connecting of a computer with a peripheral device such as a keyboard, a mouse, a monitor or a game controller. Pertinent prior art examples are disclosed in U.S. Pat. Nos. 5,518,421 and 5,725,395, and Taiwan Patent Application Nos. 85213590 and 85215055. However, due to cost ineffectiveness, the USB connector with many advantages is not yet commonly used to replace conventional electrical connectors such as a Mini Din or a D-sub.

One solution for the above-mentioned problem is to adopt an automatic process for assembly of the USB connector. However, many conventional USB connectors have a complex structure thereby hindering an automatic assembly process thereof.

Referring to FIG. 1, a conventional USB connector includes an insulative housing 2, a plurality of terminals (not shown) retained in the housing 2, a top cover (not shown.) and a front shell 1. The front shell 1 is unitarily stamped and formed from a metal plate to include a top wall 12, a pair of side walls 13 and a pair of half bottom walls 15. The half bottom walls 15 extend inwardly from edges of the side walls 13 and define a seam therebetween. The top wall 12, the side walls 13 and the bottom walls 15 cooperatively define a first space for receiving and retaining the housing 2. The side walls 13 and the bottom walls 15 cooperatively define a second space for allowing the housing 2 to move into the first space therethrough. An edge 120 of the top wall 12 is connected to a carrier 11. However, such a configuration requires a complicated structure of a stamping and forming mold thereby increasing costs. In addition, a pair of stop strips 14 is inwardly bent from edges of the side walls 13 for preventing outward movement of the housing 2 relative to the front shell 1 and a distance therebetween is adapted for allowing a number of wires (not shown) to extend therethrough. Therefore, the housing 2 can only be downwardly inserted into the second space of the front shell 1 from an above position before being inserted into the first space. However, an automatic assembly process can not insert the housing 2 into the front shell along a non-linear path. Thus, a USB connector having a structure for facilitating automatic assembly is desired.

SUMMARY OF THE INVENTION

Accordingly, a first purpose of the present invention is to provide a USB connector having a structure for facilitating automatic assembly.

A second purpose of the present invention is to provide a USB connector which is easily manufactured.

To fulfill the above-mentioned purposes, a USB connector in accordance with the present invention comprises an insulative housing, a plurality of terminals connected to corresponding wires, a top cover and a front shell. The front shell includes a bottom well, a pair of side walls upwardly extending from opposite edges of the bottom wall, and a pair of half top walls inwardly extending from edges of the side walls and defining a seam therebetween. The front shell has a mating end and an insertion end opposite the mating end. The insertion end is exposed for facilitating insertion of the housing into the front shell. A flat strain relief portion extends from the bottom wall proximate the insertion end. A carrier is connected to the strain relief portion. In an automatic assembly process, the housing is inserted into the front shell through the insertion end. Thereafter, the strain relief portion is deformed to crimp and retain the wires.

DETAILED DESCRIPTION OF THE PREFERRED EMBODIMENT

Figure 1:
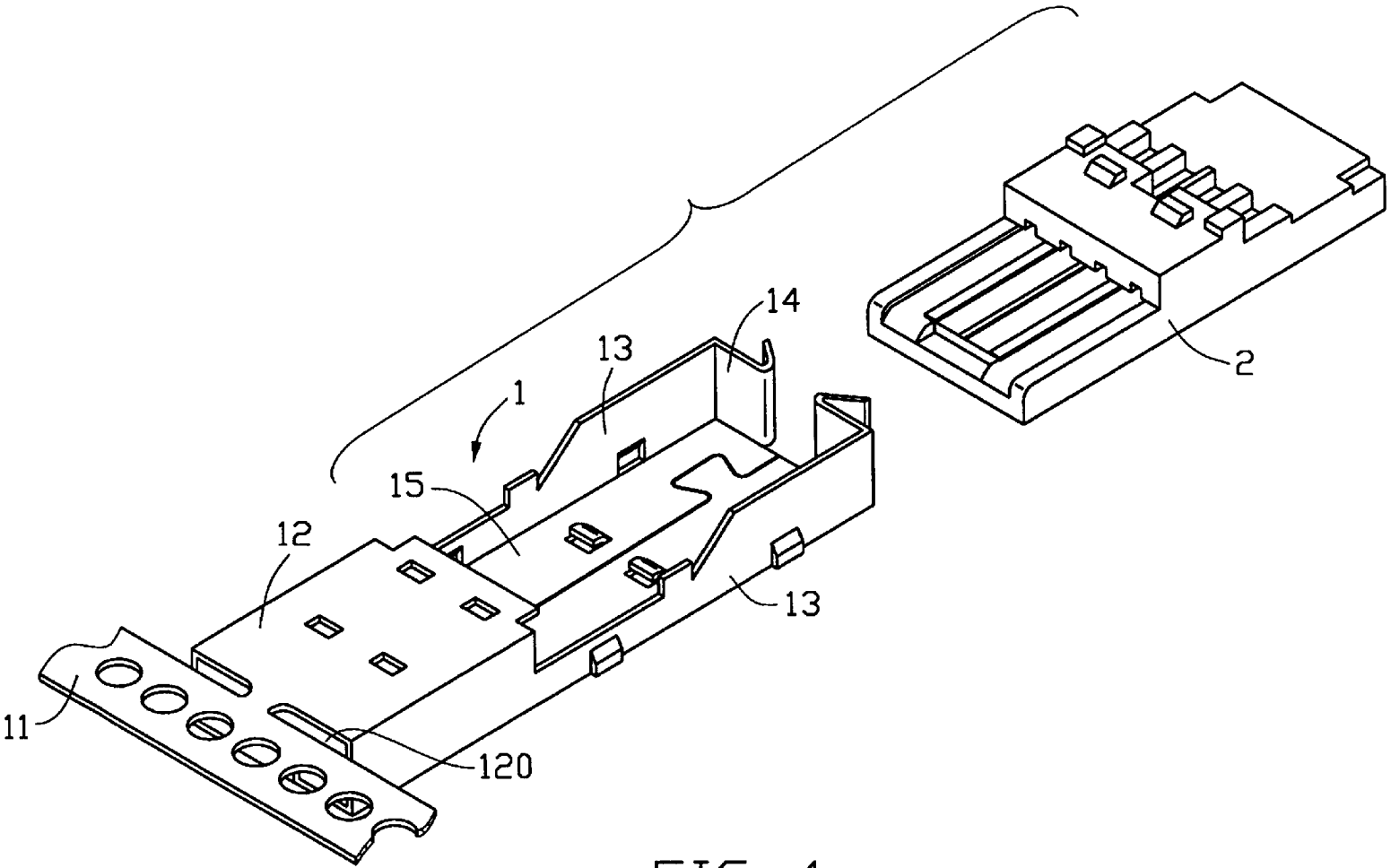
FIG. 1 (PRIOR ART)
FIG. 1 is an exploded view of a conventional USB connector.
Figure 2:
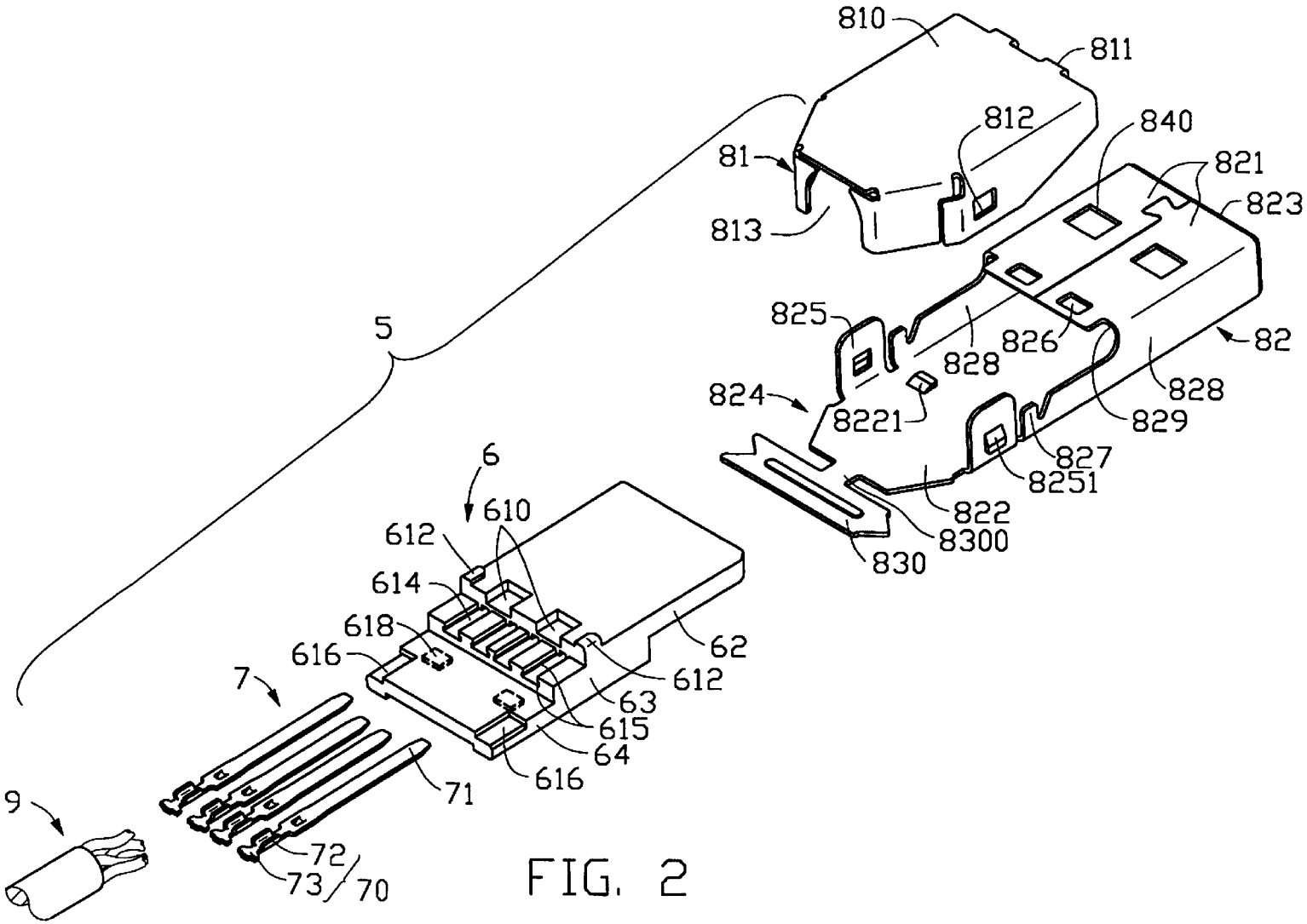
FIG. 2 is an exploded view of a USB connector in accordance with the present invention.
Figure 3:
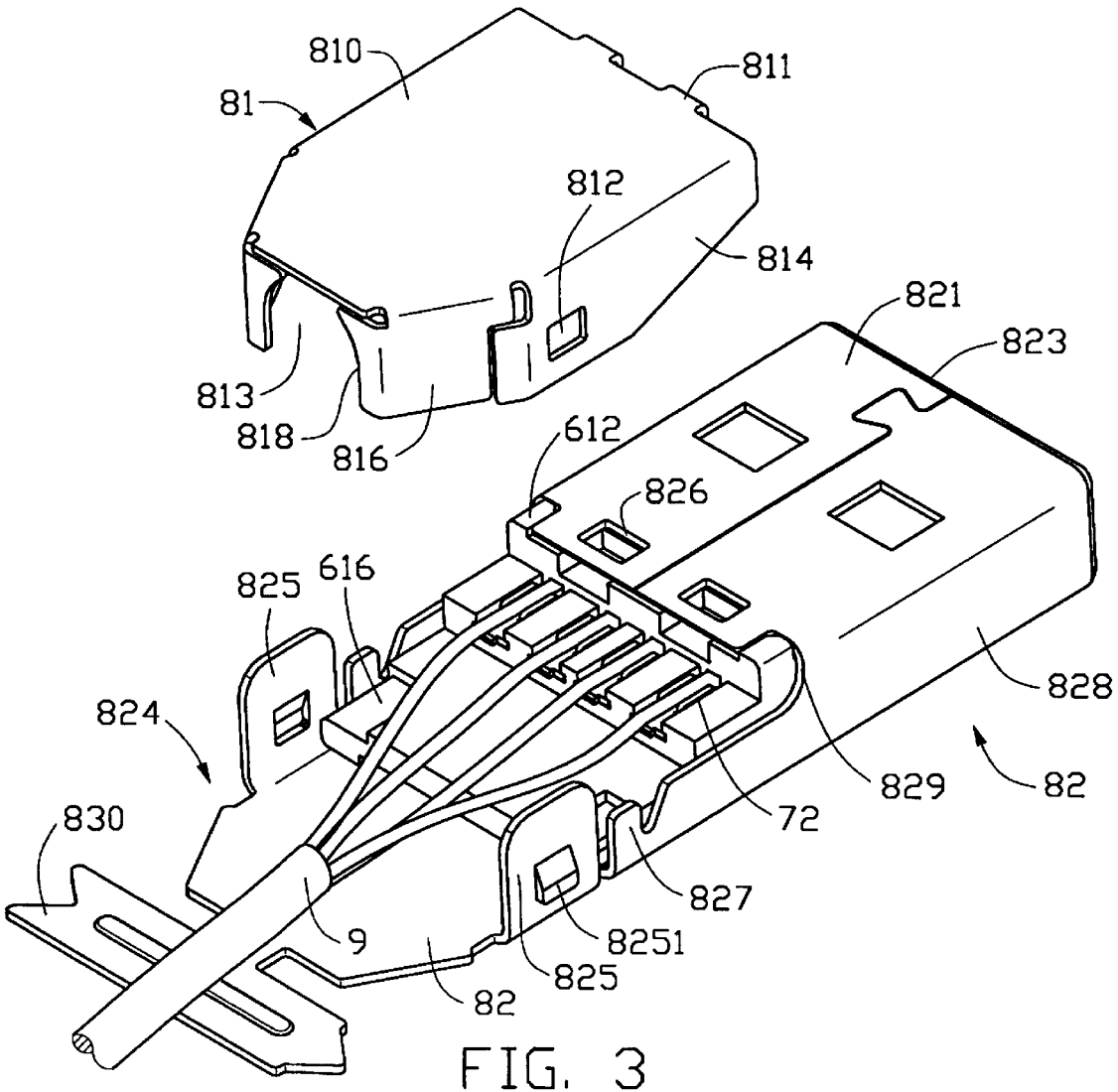
FIG. 3 is a perspective view of a USB connector of the present invention before a top cover is assembled thereto.

Referring to FIGS. 2 and 3, a USB connector 5 in accordance with the present invention comprises an insulative housing 6, a plurality of elongate terminals 7, a top cover 81 and a front shell 82. The housing 6 includes a first plate 62, a second plate 63 and a third plate 64 integrally forming a stepped configuration. A plurality of inverted T-shaped passageways 614 is defined in a junction between the first and second plates 62, 63. The passageways 614 extend along a top surface of the second plate 63 and a bottom surface of the first plate 62. A pair of fixing recesses 610 is defined in a top surface of the first plate 62 and exposed to a rear edge thereof. A pair of projections 612 is formed on the top surface of the first plate 62 proximate the rear edge and opposite lateral edges thereof. A pair of retention recesses 616 is defined exposed to a rear edge and opposite lateral edges of the third plate 64. A pair of latching recesses 618 is defined in a bottom surface of the third plate 64.

Each terminal 7 includes an elongate contact strip 71, a retention portion 70 with a pair of wings 72 extending from opposite lateral edges of the retention portion 70 and a wide portion 73. The contact strips 71 of the terminals 7 are received in the passageways 614 with the wide portions 73 fixed in bottom grooves 615 of the passageways 614. A number of wires 9 is connected to the terminals 7 wherein conductive parts of each wire are crimped and retained by the wings 72 of the corresponding terminal 7.

The front shell 82 is unitarily stamped and formed to includes a bottom wall 822, a pair of side walls 828 upwardly extending from opposite lateral edges of the bottom wall 822, and a pair of half top walls 821 inwardly extending from edges of the side walls 828 and defining a seam therebetween. The front shell 82 includes a mating end 823 and an insertion end 824 opposite the mating end 823. The top wall 821 is positioned above a portion of the bottom wall 822 proximate the mating end 823 while another portion of the bottom wall 822 is exposed. The bottom wall 822, the side walls 828 and the top wall 821 cooperatively define a receiving space dimensioned to snugly receive the housing 6. A pair of square openings 826 is defined in the top walls 821 proximate a rear edge thereof. A pair of arcurate cutouts 829 is formed in the rear edge and proximate the opposite side walls 828. A pair of square holes 840 is defined in the top walls 821 between the openings 826 and the mating end 823 for engaging with a corresponding grounding portion of a mating connector (not shown). A tab 827 is formed at an end of each side wall 828 proximate the insertion end 824. A pair of latching strips 825 upwardly extends from the opposite edges of the bottom wall 822 proximate the insertion end 824. An outwardly stamped lance 8251 is formed in each latching strip 825. A pair of inwardly stamped lances 8221 is formed in the bottom wall 822. A strain relief portion 830 is connected to the bottom wall 822 via a narrow strip 8300. A carrier (not shown) is connected to the strain relief portion 830 to reliably retain the front shell 82 during a stamping and forming process.

The housing 6 is inserted into the receiving space of the front shell 82 from the insertion end 824. The projections 612 of the housing 6 are engaged with and stopped by the arcurate cutouts 829 of the front shell 82 thereby preventing forward movement of the housing 6 relative to the front shell 82. The openings 826 of the front shell 82 are aligned with the fixing recesses 610 of the housing 6. The tabs 827 are inwardly bent to engage in the retention recesses 616 thereby preventing rearward movement of the housing 6 relative to the front shell 82. The lances 8221 of the front shell 82 engage the latching recesses 618 for securing purposes. It should be noted that the front shell 82 has no structure which may interfere with insertion of the housing 6 thereinto. Therefore, the housing 6 can be conveniently assembled to the front shell 82 by an automatic assembly process which is time and cost efficient.

The top cover 81 is unitarily stamped and formed to include a planar top portion 810, a pair of front lateral walls 814 downwardly extending from opposite edges of the top portion 810 and a pair of rear lateral walls 816 downwardly extending from the top portion 810. A pair of hooks 811 extends from a front edge of the top portion 810. A window 812 is defined in each front lateral wall 814. The rear lateral walls 816 form inwardly extending arcurate edges 818 defining a passage 813 therebetween for extension of the wires 9 therethrough.

Figure 4:
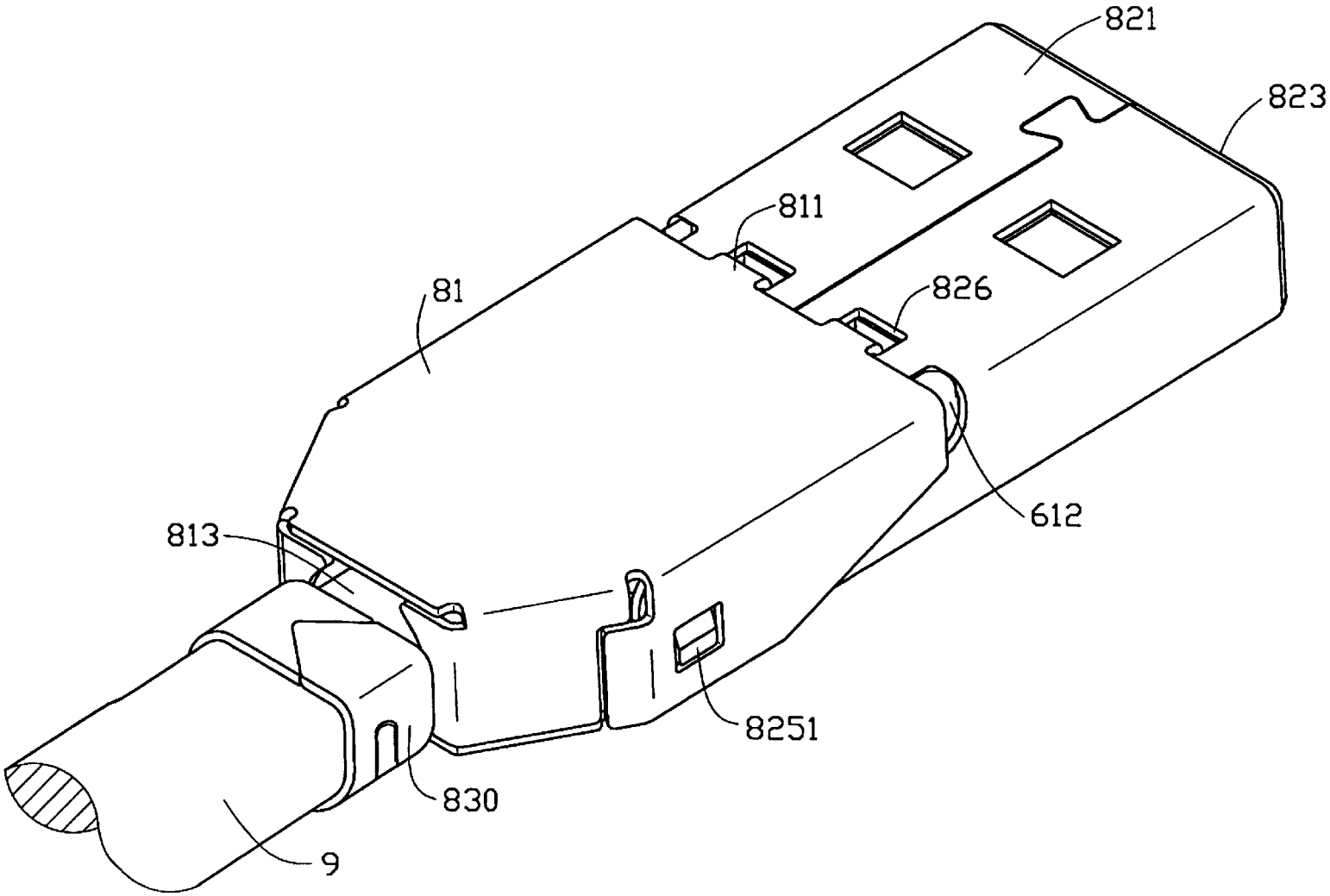
FIG. 4 is an assembled view of FIG. 2.

Also referring to FIG. 4, the top cover 81 is assembled to the front shell 82 to cooperatively enclose the housing 6. The hooks 811 of the top cover 81 engage the openings 826 of the front shell 82 and extend into the fixing recesses 610 of the housing 6 for securing purposes. The windows 812 of the top cover 81 snappingly engage with the lances 8251 of the front shell 82. Thus, the upper and front shells 81, 82 are reliably secured together to shield the housing 6 and the terminals 7 from exterior interference. The wires 9 extend through the passage 813 of the top cover 81 and rest on the strain relief portion 830. Thereafter, the strain relief portion 830 is inwardly bent by a tool to crimp and retain the wires 9.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector comprising:

an insulative housing defining a plurality of passageways;

a plurality of terminals received in the passageways and adapted to connect to corresponding wires, each terminal including a contact strip and a retention portion;

a metallic top cover; and a metallic front shell being assembled with the top cover to enclose the housing, the front shell including an insertion end, the insertion end being open and exposed for facilitating insertion of the housing into the front shell, wherein the front shell includes a bottom wall, and a pair of side walls upwardly extending from opposite edges of the bottom wall, a pair of half top walls inwardly extending from edges of the side walls and defining a seam therebetween, a part of the bottom wall proximate the insertion end being exposed for facilitating automation insertion operation of the housing;

wherein the top wall of the front shell defines a pair of openings for engaging with a pair of hooks formed on a front edge of the top cover for securing purposes;

wherein a pair of latching strips extends from opposite edges of the bottom wall and forms outwardly stamped lances for engaging with corresponding windows defined in a pair of lateral walls of the top cover;

wherein a pair of arcuate cutouts is formed in a rear edge of the top wall proximate the side walls of the front shell to engage with and be stopped by a pair of projections formed on a top surface of the housing;

wherein a pair of tabs upwardly extends from opposite edges of the bottom wall and is bent to engage with a pair of retention recesses formed in the housing after the housing is inserted into the front shell;

wherein a stress relief portion is connected to the bottom wall;

wherein the top cover includes a pair of lateral walls forming arcuate edges to define a passage for extension of the wires therethrough;

wherein the retention portion of each terminal includes a wide portion and a pair of wings extending from opposite edges thereof for crimping and retaining the corresponding wire.

* * * * *